US005356019A

United States Patent [19]

Kelly

[11] Patent Number: 5,356,019

[45] Date of Patent: Oct. 18, 1994

[54] TAMPER INDICATING PLASTIC CLOSURE

[75] Inventor: Ronald L. Kelly, Chester, Va.

[73] Assignee: Crown Cork & Seal Company, Inc., Philadelphia, Pa.

[21] Appl. No.: 961,134

[22] Filed: Oct. 14, 1992

[51] Int. Cl.[5] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 4,488,655 | 12/1984 | Itsubo et al. | 215/252 |
| 4,635,808 | 1/1987 | Nolan | 215/252 |
| 4,694,971 | 9/1987 | Elsmo et al. | 215/253 |
| 4,726,482 | 2/1988 | Barriac | 215/252 |
| 4,784,280 | 11/1988 | Breuer et al. | 215/252 |
| 4,813,561 | 3/1989 | Ochs | 215/252 |
| 4,938,370 | 7/1990 | McBride | 215/252 |
| 4,978,017 | 12/1990 | McBride | 215/252 |
| 5,090,788 | 2/1992 | Ingram et al. | 215/252 |
| 5,107,998 | 4/1992 | Zumbuhl | 215/252 |
| 5,167,335 | 12/1992 | McBride et al. | 215/252 |

*Primary Examiner*—Allan N. Shoap
*Assistant Examiner*—Vanessa Caretto
*Attorney, Agent, or Firm*—Woodcock, Washburn, Kurtz, Mackiewicz & Norris

[57] ABSTRACT

A plastic tamper-indicating closure (1) possesses a closure cap (2) on which, by means of weakened web portions (5), a tamper-indicating band (6) is fixed. The tamper-indicating band (6) is provided with a number of blocking elements (8). The blocking elements (8) are connected with the tamper-indicating band via integral hinges (7). During screwing onto the container neck, the blocking elements (8) can be pivoted upwards and radially outwards into a first closed position (I). As opposed to this, during opening of the tamper-indicating closure the blocking elements are pivoted downwards and radially inwards into a second opening position (II). With that, the effective internal diameter will be reduced, by which means the blocking element will be held in engagement with the corresponding locking surface on a container neck.

8 Claims, 4 Drawing Sheets

Figure 4:
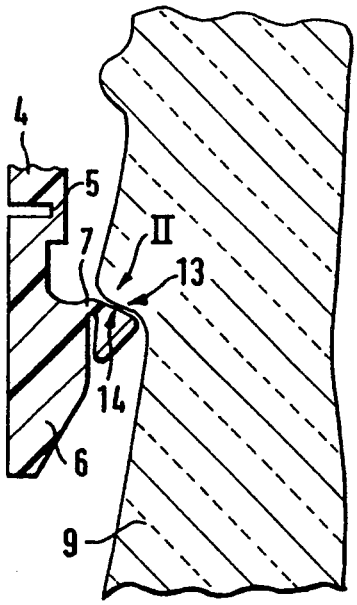

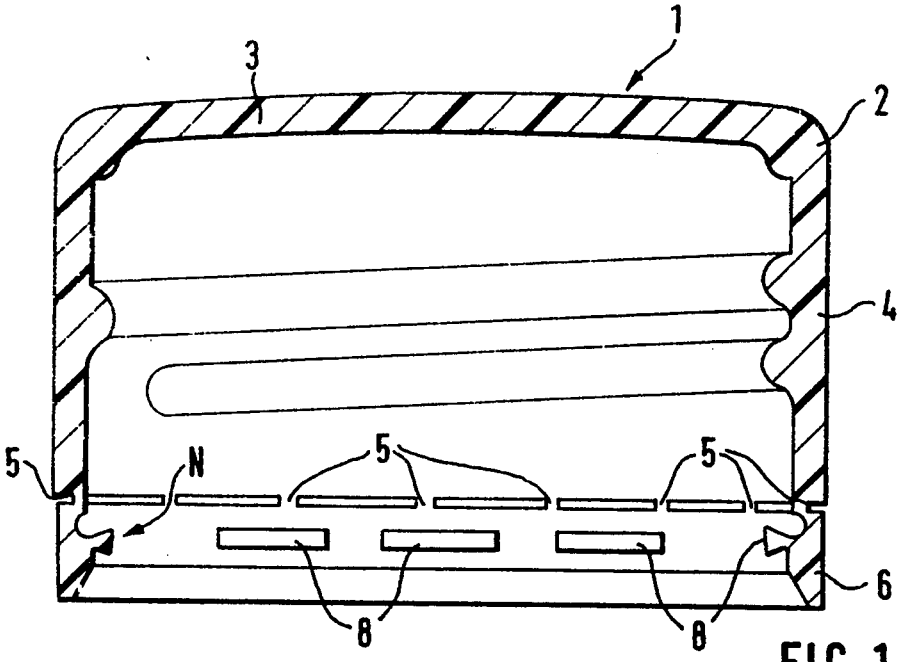
FIG. 1
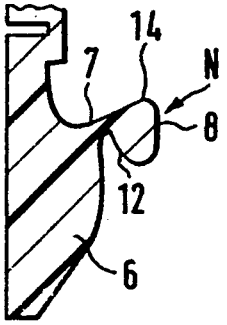
FIG. 2
FIG. 3
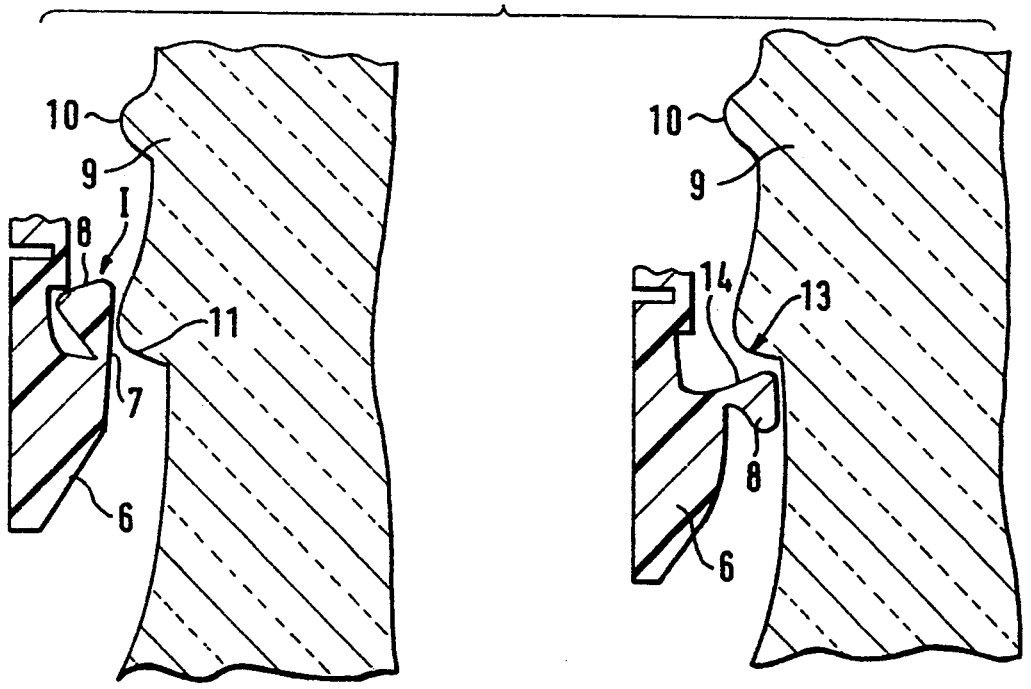

TAMPER INDICATING PLASTIC CLOSURE

The invention concerns a tamper-indicating plastic closure for a container, said container possessing a neck on which at least one radial locking surface protrudes outwardly. The guarantee function of these kinds of closures is such that when the plastic cap is removed for the first time, the tamper-indicating band is torn into or at least partly torn away. Through tearing into or tearing away, it is made clear to the consumer that the container has already been opened.

The tamper-indicating band can, with that, completely surround the container neck or extend merely over a part of the circumference. With that, the separating lines at which the tamper indicating band tears can be not only horizontal, i.e. parallel to the base of the cap, but also vertical. For example, the intention could be for the tamper-indicating band to tear away from the plastic cap as a complete ring, at the same time remaining on the container neck. In other cases it may be desirable that the tamper-indicating band, or the torn-away parts of the tamper-indicating strip, remain attached to the plastic cap. The invention in question incorporates all these embodiments.

The containers to be closed can be glass or plastic beverage bottles. At the same time, other containers can also be involved, such as, for example, preserving jars, wide-mouth-containers and similar.

In most cases a bead is provided on the neck of these containers, the underside of which forms the locking surface with which the tamper-indicating band of the plastic cap engages. Naturally, the invention is not restricted to a circumferential bead of this type. For example, individual, sectionally attached beads or other retaining elements, including depressions in the container neck, can also be provided, without departing from the framework of the invention. In principle, it is here only fundamental that there is an outwardly protruding locking surface running straight, curved, regularly or irregularly and engaging, during placement onto a container, with a blocking element on the plastic cap, respectively the tamper-indicating band, in order to prevent unscrewing of the plastic cap without the weakened portions being damaged.

Normally, these types of plastic caps possess a single-start or multi-start thread. Naturally, the invention permits use with plastic caps which are connected to the container neck in other ways. For example, included here are plastic caps with snap fastenings or bayonet fastenings.

These types of tamper-indicating closures are, for example, known from U.S. Pat. No. 4,978,017, U.S. Pat. No. 5,090,788 or U.S. Pat No. 4,784,280, as well as U.S. Pat. No. 4,635,808.

With known tamper-indicating closures, elastic tongues or "flaps" are provided as retaining elements for mechanical engagement of the tamper-indicating band onto the container neck. These tongues or "flaps" reduce the effective internal diameter of the tamper-indicating band so that, during placement, it will snap over the locking surface on the container neck and so will engage. With some of the known tamper-indicating closures, in this engaged position the tongues or flaps run horizontally or slightly inclined downwards. In order to be able to carry out their locking function, they must therefore be formed to be relatively rigid. This can lead to difficulties when placing the closure onto the container neck. For this reason, the employment of somewhat more elastic flaps, and their support by beads arranged beneath the flaps, has been already suggested. As far as these protrusions are concerned, however, they reduce the effective internal diameter of the tamper-indicating band, which can likewise lead to difficulties when placing the closure onto the container.

In the case of another category of closures, the flaps point inclined upwards and inwards after placement onto the container. The flaps engage with their facing sides on the locking surface and the force arising during opening is transferred by the flaps to the tamper-indicating band, approximately along their longitudinal axis. These types of flaps must possess great elasticity in order to enable placement of the closure onto the container neck. This can, in addition, lead to elastic distortion when opening, without the tamper-indicating band being torn at the same time. Apart from that, it is relatively difficult to manufacture these types of flaps which point into the plastic cap, inclined in relation to the cap base. Mainly with tamper-indicating closures which are manufactured from plastic by the injection molding method, this shape is normally accompanied by a separate manufacturing step, which increases manufacturing costs.

It is thus a purpose of the invention to create a tamper-indicating closure of the type described above, for the closure of these types of containers, which on the one hand is able to be mass produced in a simple way and on the other hand reliably fulfils its guarantee function, and with that is easy to place onto the container neck without the weakened portions being subjected to damage during this placement.

According to the invention, this task is fulfilled mainly through the different individual features of the patent claims, as well as the combination and sub-combination of these features.

With that, according to the invention, the arrangement of a blocking element is suggested, with particular advantage, which is connected with the tamper-indicating band by at least one integral hinge, and which engages beneath the locking surface after placement of the tamper-indicating closure onto the container neck and which locks the tamper-indicating band on the container neck. Whilst, with known tamper-indicating closures, the flaps or retaining elements are themselves formed to be flexible in order to be able to engage like a spring over the locking surface when placing onto the container, the invention suggests the employment of, in practice, a substantially rigid blocking element which is connected to the tamper-indicating band by means of an elastic, sprung integral hinge. The blocking elements possess, with that, an upper retaining surface with which they can be brought into engagement with the locking surface on the container neck. Apart from that, they are provided with a lower supporting surface which is able to be supported on the surface of the inner wall of the tamper-indicating band. The blocking elements can, with that, on the one hand yield and pivot upwards by means of the integral hinges when placing the tamper-indicating band onto the container, through which the placement sequence can proceed without problems. If, on the other hand, when opening of the tamper-indicating closure, the blocking elements are pivoted in the opposite direction about the integral hinges, they will support themselves on the supporting surface on the inner wall of the tamper-indicating band. The engagement of the blocking elements with the locking surface on the container neck is in this way so fixed that opening of the tamper-indicating closure without destruction of the weakened portions is practically impossible. With that, the blocking elements with their supporting surfaces can support themselves either directly on the surface of the inner wall of the tamper-indicating band, or indirectly, for example by means of supporting beads or raised portions of the tamper-indicating band. It is here only fundamental that the force arising on the blocking elements when opening the tamper-indicating closure is transferred to the tamper-indicating band, so that the severing line is separated.

It is also a principle feature that the blocking elements are so fixed to the integral hinges that they project radially inwards in an intermediate position before placement onto the container. "Radially inwards" shall include, with that, not only an approximately horizontal position, but also a position upwardly inclined in relation to the cap base, or a position inclined in the opposite direction. Fundamental to the intermediate position is that the blocking element here projects radially inwards from the tamper-indicating band in such a way that, when placing the tamper-indicating closure onto a container, this container can pivot the blocking elements about the integral hinges upwards towards the cap base and outwards in relation to the skirt portion, so that the container neck can protrude into the tamper-indicating closure without at the same time the weakened portions being subjected to damage. This is possible because the blocking elements, during pivoting about the integral hinges, displace outwards away from the container and enlarge the effective inside diameter of the tamper-indicating band.

After placement of the tamper-indicating band, the blocking elements, which have pivoted elastically about the integral hinges, snap back again and locate themselves beneath the locking surfaces on the container neck. This type of elastic or sprung disengagement can be practically realised with all plastic materials normally employed for these types of closures. This applies, for example, also in particular for polyethylenes and polypropylenes.

It is therefore fundamental that the blocking elements, during pivoting into the closed position of the tamper-indicating band, are pivoted sufficiently upwards and outwards so that they can pass the container neck and the locking surfaces unrestricted, and that, after placement of the tamper-indicating band onto the container neck, the blocking elements spring or snap under the locking surface on the container neck.

A further, fundamental feature of the closure according to the invention is that, during initial removal of the closure from the container neck, the blocking elements are moved downwards and radially inwards by the locking surfaces. This radially inward pivoting obviously causes a reduction of the effective internal diameter of the tamper-indicating band so that the blocking elements come into still closer engagement with the locking surface or surfaces on the container neck and overlap it or them and by this means hold the tamper-indicating band firmly onto the container neck. As opposed to known flap arrangements, the pivoting movement of the blocking elements therefore causes a reduction of the effective internal diameter of the tamper-indicating band, and with that a firm grip on the container neck.

In this second opening position with reduced effective internal diameter, the supporting surfaces of the blocking elements come into engagement with the tamper-indicating band and in this position support the blocking elements.

The tamper-indicating closure will possess particularly good opening and locking characteristics if the blocking elements are able to be pivoted between the closed position and the opened position through an angle of more than 100 degrees, preferably more than 140 degrees. Mainly in the case of commercially available beverage bottles, particulary good results can be aimed at if the pivoting angle amounts to between approximately 160 degrees to 180 degrees. A particulary stable locking function of the blocking elements will arise if their retaining surface in each case encloses an angle of more than 60 degrees with the supporting surface, preferably between 70 degrees and 100 degrees.

The blocking elements can connect with the locking surface on the container neck particularly securely if the blocking elements, seen in plan view, possess the shape of an annular segment whose circle runs coaxially with the tamper-indicating band. The length and number of these annular segments can be further determined without problems, depending on the configuration of the container neck and the supporting surface. A number of between 10 and 14 blocking elements has proved itself to be particularly favourable in the case of beverage bottles with a 28 mm diameter.

According to the shape of the supporting surfaces, the blocking elements can however, in plan view, possess other shapes. For example, they can run in straight lines if, for example, the supporting surface in plan view takes the shape of a polygon.

Flexible material bridges between the tamper-indicating band and the blocking elements are particularly suitable as integral hinges. The flexible bridges can be provided along the entire length of the blocking element. It would also be conceivable to provide the flexible bridges only in partial areas of the blocking elements, for example at both their outer ends or in their centres.

The severing line along which the tamper-evident band or individual tamper-indicating band segments may be torn off, can be best formed as severable ribs or bridges or as material webs which have appropriately thin dimensions in order to tear during opening. It would naturally be also conceivable, in place of the webs, to provide segments or a continuous ring of thin material membrane which tears under load or stress.

In most cases a plurality of blocking elements will provide best results. However, for certain container configurations it is conceivable to provide, for example, only one blocking element on one side of the diameter and to combine it with one or more beads or other protrusions on the opposite side of the tamper evident band. It is also possible to provide much larger blocking elements which, for example may have the form of larger segment of a circle or form a circle.

Examples and embodiments of the invention are more closely described in the following, illustrated by the drawings. Namely:

FIG. 1 A schematic representation of a tamper-indicating closure with the features of the invention, in cross-section, FIG. 2 the tamper-indicating band, according to FIG. 1, in an enlarged representation and in a position before placement on a container and during placement on a container.

Figure 5:
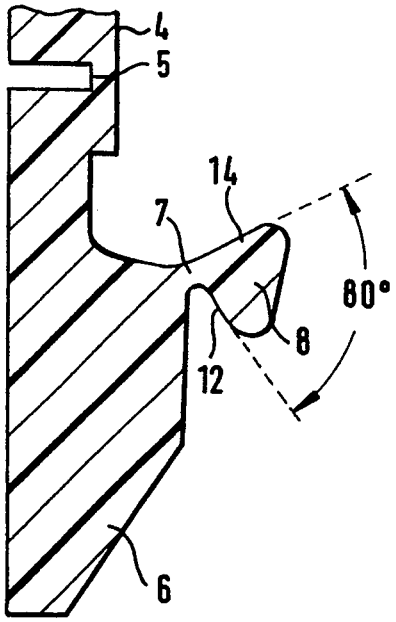
Figure 6:
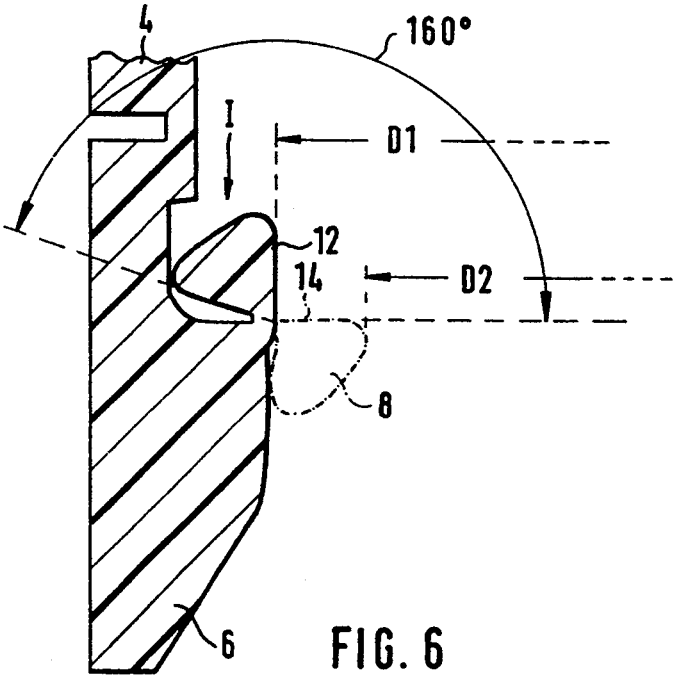
Figure 7:
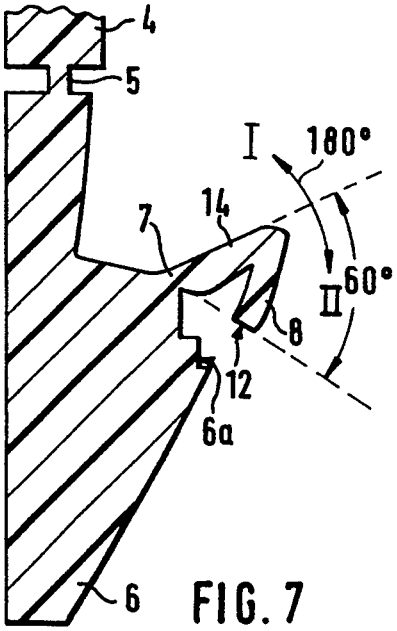
Figure 8:
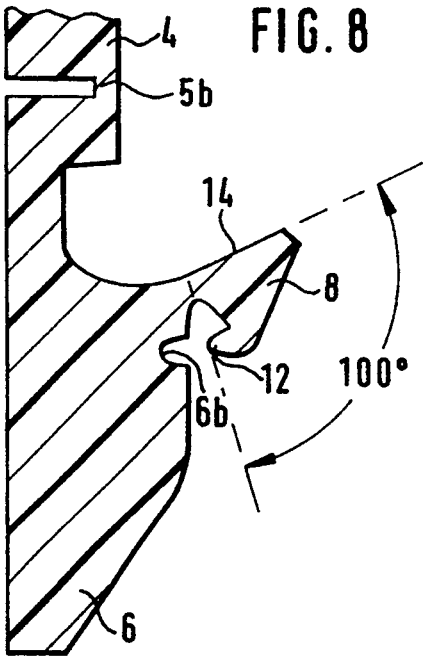
Figure 9:
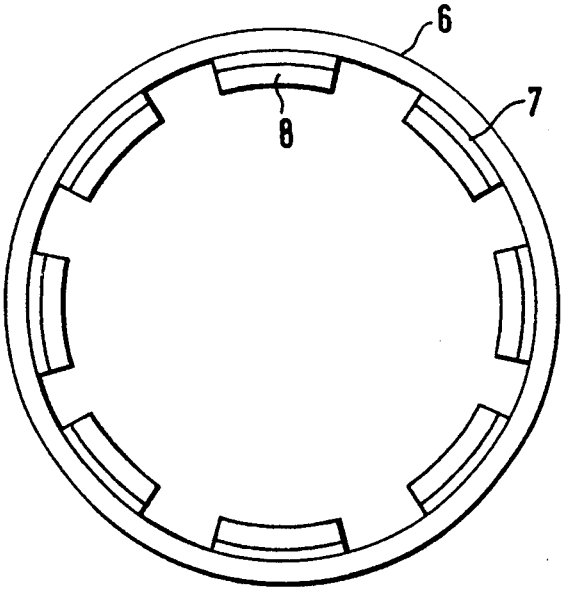

FIG. 3 the tamper-indicating band, according to FIGS. 1 and 2, after placement onto the container neck, FIG. 4 the tamper-indicating band, according to FIGS. 1 to 3, during opening of the tamper-indicating closure, FIG. 5 a further enlarged representation of a tamper-indicating band with the features of the invention, FIG. 6 a tamper-indicating band with representation of a blocking element in the first closed position and the second opened position, FIG. 7 a tamper-indicating band with a modified blocking element, FIG. 8 a tamper-indicating band with a further embodiment of a blocking element, FIG. 9 the plan view of a tamper-indicating band with numerous blocking elements, and FIGS. 10 to 15 modified versions of blocking elements.

According to FIG. 1, a tamper-indicating closure 1 possesses a plastic cap 2, which comprises a cap base 3 and a cylindrical skirt portion 4. A tamper-indicating band 6 is fixed by means of numerous weakened web portions 5 to the plastic cap 2.

As can be seen particularly well from FIGS. 2 to 6, a number of blocking elements 8 are arranged on the tamper-indicating band 6 by means of material bridges taking effect as integral hinges 7.

The plastic cap 2 is, together with the tamper-indicating band 6 and the blocking elements 8, manufactured in one piece in a known way through plastic injection molding. Naturally, the tamper-indicating band can also be manufactured by the compression molding method or in another suitable way. It would also be conceivable to manufacture the tamper-indicating band 6 and the plastic cap 2 separately and, in a separate working step, to combine them interlockingly or in another way, without at the same time departing from the framework of the invention. These types of separately manufactured tamper-indicating bands are known, for example, from the U.S. Pat. No. 4,578,857.

Prior to screwing onto the container neck 9, the blocking elements are located in position N according to FIG. 1 and the upper representation in FIG. 2. As soon as the plastic cap is displaced downwards relative to the container neck during the screwing on procedure, the blocking element 8 becomes engaged with the thread portions 10, as well as the circumferential, annular protrusion 11. The blocking elements 8 are, as a result, pivoted upwards and radially outwards about the integral hinge 7 as a point of rotation, so that the effective internal diameter of the tamper-indicating band 6 enlarges and the tamper-indicating band 6 can pass over the protrusion 11 into the position shown in FIG. 3, without the weakened web portions 5 at the same time being damaged. In the intermediate position N, the blocking elements 8 are aligned radially inwards, it being not essential, in this position, if they point either slightly upwards or slightly downwards, since through the elasticity of the integral hinge 7, pivoting into the first closed position I is in any case possible. The supporting surfaces 12 of the blocking elements 8 determine the enlarged first internal diameter D1, in the closed position I (See FIG. 6).

After complete screwing of the tamper-indicating closure 1 onto the container neck 9, the blocking elements 8 will locate beneath the protrusion 11 and its locking surface 13, which is oriented towards the retaining surface 14 of the blocking elements 8.

FIGS. 4 and 6 show how, during opening of the tamper-indicating closure, the retaining surface 14 engages with the locking surface 13, the blocking elements 8 being pivoted radially inwards and downwards into the second opening position II and with that determining the second reduced internal diameter D2. At the same time, the blocking elements 8 intensify their engagement with the locking surface 13, so that the tamper-indicating band 6 cannot be pulled over the protrusion 11. During opening of the tamper-indicating closure the weakened web portions 5 will thus tear.

As is suggested in FIG. 5, the retaining surface 14 and the supporting surface 12 of the blocking elements 8, seen from the integral hinge 7, enclose an angle of approximately 80 degrees. This configuration ensures especially good stability or inflexibility of the blocking elements 8 and enables, on the other hand, pivoting of the blocking elements through an angle of approximately 160 degrees, as represented in FIG. 6, which is advantageous for the opening and closing functions.

FIG. 7 shows a modified version with which the blocking elements possess an approximately V-shaped cross-section. Such a cross-sectional shape enables particularly simple and rapid removal of the tamper-indicating closure from a radially ejecting injection casting tool.

In order to additionally ensure stability and the supporting function of these blocking elements 8, the inner wall of the tamper-indicating band 6 is provided with a supporting protrusion 6*a*, on which the supporting surface 12 can support itself. With the version according to FIG. 7, the supporting surface 12 encloses an angle of approximately 60 degrees with the retaining surface 14. On the basis of the arrangement of the integral hinge 7, pivoting of the blocking element 8 from the first closed position I into the second open position II through approximately 180 degrees is possible.

FIG. 8 shows a modified version with which the supporting surface 12 of the blocking element 8 is formed as a bead type protrusion, which is able to be supported in a corresponding depression 6*b* in the tamper-indicating band 6. Instead of individual bridges or web portions 5, the band 6 according to FIG. 8 is connected to skirt portion 4 by a very thin continuous (about 360°) web 5*b*.

FIG. 9 shows a plan view of the tamper-indicating band (from below). From this it can be seen that the integral hinges 7, for fastening of the blocking elements 8 onto the tamper-indicating band 6, run along the entire length of the blocking elements 8. Not only the integral hinges 7, but also the blocking elements 8 are shaped as annular segments and run coaxially to the tamper-indicating band 6.

Figure 10:
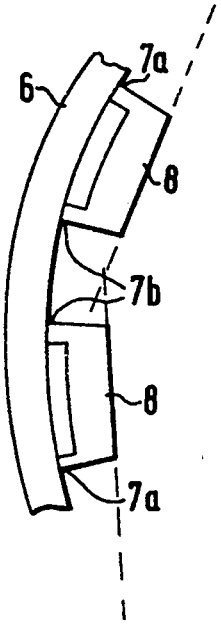

FIG. 10, on the other hand, shows a version with which the blocking elements 8 in each case are connected, with an integral hinge 7*a*, 7*b* on both ends, to the tamper-indicating band 7*a*, 7*b*. This configuration permits particularly easy pivoting of the blocking elements 8 when placing onto the container neck.

Apart from that, the blocking elements in the case of FIG. 10 are straight-lined, and not formed as annular elements.

Figure 11:
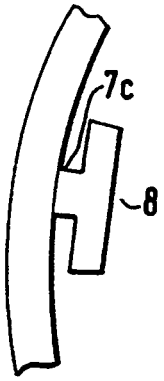

The version according to FIG. 11 shows the schematic representation of a blocking element 8 which is connected to the tamper-indicating band 6 by means of a centrally arranged web shaped integral hinge 7*c*.

Figure 12:
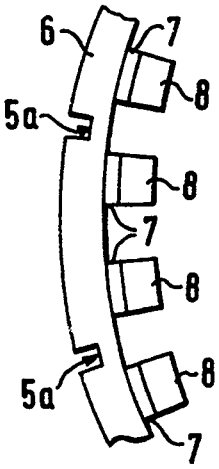

In the case of the version according to FIG. 12, numerous relatively narrow blocking elements 8 are provided, weakened portions 5*a*, which enable radial tearing of the tamper-indicating band 6, being provided in addition to the weakened portions 5 between the tamper-indicating band 6 and the skirt portion 4, as shown in FIGS. 1 to 8.

Figure 13:
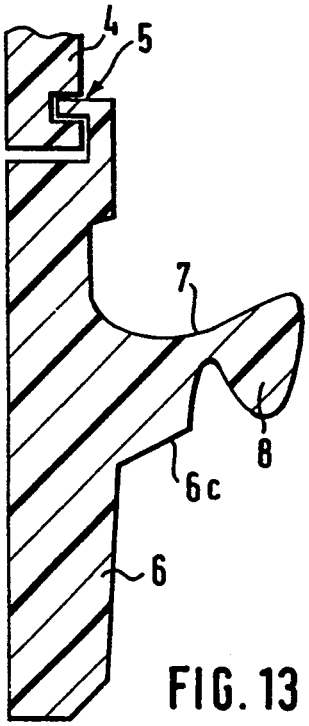

With the embodiment according to FIG. 13, a protrusion 6*c* is provided on the tamper-indicating band 6 which carries the allocated blocking element 8 by means of the integral hinge 7. This arrangement permits on the one hand a particularly thin configuration of the tamper-indicating band 6 and on the other hand enlarges the pivot angle of the blocking element 8 from the first closed position I into the second open position II. (FIG. 6)

Figure 14:
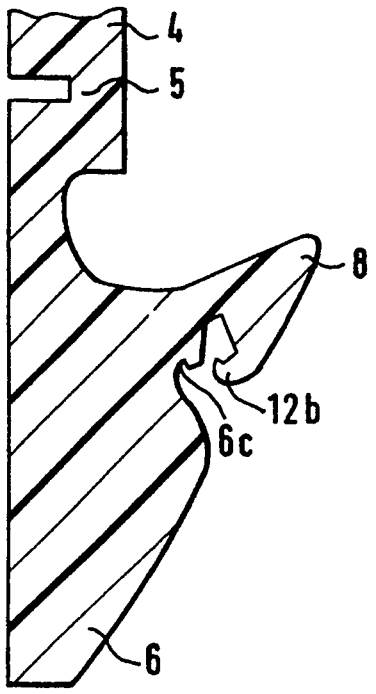

FIG. 14 shows a modified version of the blocking element 8 according to FIG. 8. The bead type protrusion 12*b* is formed as a hook which engages with the corresponding surface of depression 6*c*. If blocking element 8 is turned downwardly as a consequence of turning closure 1 or any manipulation, the blocking element will be locked in its downward position. This increases manipulation safety.

Figure 15:
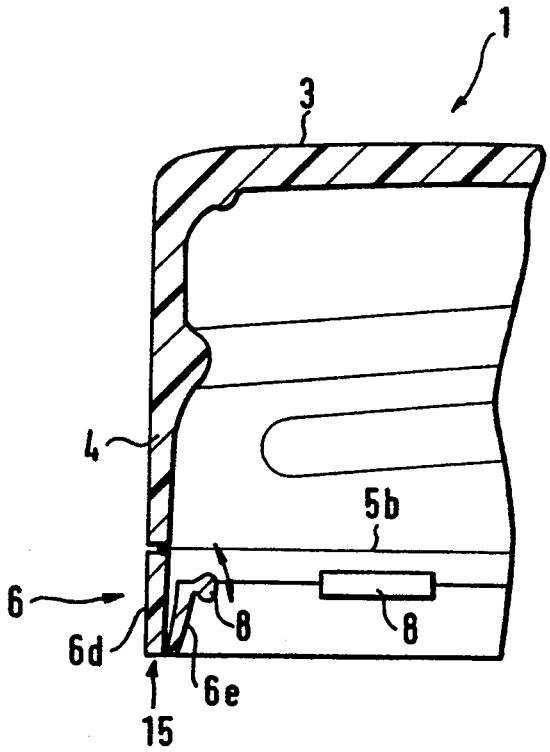

FIG. 15 shows a modified version of tamper-indicating band 6. Band 6 comprises an outer band portion 6*d* which extends downwardly from the continuous thin web 5*b* which forms a line of severing. Band 6 further comprises an inner band portion 6*e* which is connected to the outer portion along line 15 and which extend upwardly and radially inwardly. Blocking elements 8 are protruding from the inner surface of the inner band portion 6*e* as disclosed in connection with the embodiments of FIGS. 1 to 14.

When placing this cap on a container the inner band portion 6*e* may be flexed outwardly as well as the blocking elements 8 are turned upwardly and outwardly thereby defining the first larger diameter (D1).

When the closure 1 is opened, the blocking elements 8 are pivoted downwardly and inwardly whereby the inner band portion 6*e* may be flexed inwardly in addition to further reduce the free inner diameter defined by the inner surface of the blocking elements 8.

Inasmuch as the invention is subject to modifications and variations, the foregoing description and accompanying drawings should not be regarded as limiting the invention, which is defined by the following claims and various combinations thereof.

I claim:

1. A tamper-evident closure cap for a container of the type that has a neck portion (9) and a locking surface (13) protruding radially outwardly from the neck portion (9), comprising:

a plastic cap (2) having a base (3) and a cylindrical skirt portion (4) attached to said base (3);

a tamper-indicating band (6) at least partially detachably mounted to said skirt portion (4);

a plurality of blocking elements (8), each of said blocking elements (8) comprising a substantially nonflexible solid mass that defines an upper retaining surface (14) and a lower supporting surface (12);

a plurality of flexible hinges (7) extending radially inwardly from an inner surface of the tamper-indicating band, each of said hinges (7) being connected to said tamper-indicating band (6) at a first end and to one of said blocking elements (8) at a second end, said hinges (7) being substantially less thick than said blocking elements (8);

wherein said blocking elements (8) are constructed and arranged so that each (i) pivots upwardly on its respective hinge (7) into a recess in the tamper-indicating band by contact of said lower supporting surface (12) with said locking surface (13) during installation of said cap (2) on a neck portion (9) of a container; and (ii) pivots downwardly beneath said locking surface (13) once said cap (2) is sufficiently installed so that said locking surface (13) is positioned above the blocking element (8), and wherein said lower supporting surface (12) is positioned at an angle with respect to said upper retaining surface (14), said angle being substantially in the range of 60°–100°, and blocking elements (8) are sufficiently thick that, in the installed position, said upper retaining surface (14) and said lower retaining surface (12) are sufficiently close to said locking surface (13) and an inner surface of said tamper-indicating band (6), respectively, that said blocking element (8) cannot be bent to be pried back with a knife or other thin object to slip said tamper-evident band (6) back over said locking surface (13) by one who is attempting to overcome the tamper-evident protection of said closure cap.

2. A closure cap according to claim 1, wherein said blocking elements (8) are wedge-shaped.

3. A closure cap according to claim 2, wherein said angle is substantially between 70 and 100 degrees.

4. A closure cap according to claim 3, wherein said angle is substantially 80 degrees.

5. A tamper-evident closure cap according to claim 1, wherein said blocking element (8) is constructed and arranged to pivot during installation through an angle of at least 100 degrees.

6. A tamper-evident closure cap according to claim 5, wherein said blocking element (8) is constructed and arranged to pivot during installation through an angle of at least 140 degrees.

7. A tamper-evident closure cap according to claim 6, wherein said blocking element (8) is constructed and arranged to pivot during installation through an angle of about 160 degrees to 180 degrees.

8. A tamper-evident closure cap according to claim 1, wherein each hinge (7) comprises at least one flexible bridge connecting said tamper-indicating band (6) with each of said blocking elements (8).

* * * * *